US011850634B2

(12) United States Patent
Kümmel et al.

(10) Patent No.: US 11,850,634 B2
(45) Date of Patent: Dec. 26, 2023

(54) METHOD AND DEVICE FOR RINSING AN OVERFLOW CHAMBER AT THE BATH-SIDE END OF A SNOUT OF A HOT-DIP COATING DEVICE

(71) Applicants: SMS group GmbH, Düsseldorf (DE); Fa. Severstal, Cherepovets (RU)

(72) Inventors: Lutz Kümmel, Jüchen (DE); Jegor Bergen, Rheinberg (DE); Jean-Pierre Crutzen, Chaudfontaine (BE); Otto Schanderl, Salzgitter (DE)

(73) Assignees: SMS group GmbH, Düsseldorf (DE); Fa. Severstal, Cherepovets (RU)

( * ) Notice: Subject to any disclaimer, the term of this patent is extended or adjusted under 35 U.S.C. 154(b) by 65 days.

(21) Appl. No.: 17/609,697

(22) PCT Filed: Jul. 23, 2019

(86) PCT No.: PCT/EP2019/069811
§ 371 (c)(1),
(2) Date: Nov. 8, 2021

(87) PCT Pub. No.: WO2020/224792
PCT Pub. Date: Nov. 12, 2020

(65) Prior Publication Data

US 2022/0213582 A1 Jul. 7, 2022

(30) Foreign Application Priority Data

May 8, 2019 (DE) ..... 10 2019 206 609.7

(51) Int. Cl.
*B08B 9/08* (2006.01)
*C23C 2/40* (2006.01)
*C23C 2/00* (2006.01)

(52) U.S. Cl.
CPC ..... *B08B 9/08* (2013.01); *C23C 2/00* (2013.01); *C23C 2/004* (2022.08);
(Continued)

(58) Field of Classification Search
None
See application file for complete search history.

(56) References Cited

U.S. PATENT DOCUMENTS 6,936,307 B2 8/2005 Dauchelle et al.
6,939,586 B2 9/2005 Dauchelle et al.
(Continued)

FOREIGN PATENT DOCUMENTS

CN 102925839 A 2/2013
CN 106164322 A 11/2016
(Continued)

OTHER PUBLICATIONS

JPH0459955 English Translation, accessed on Mar. 2023. (Year: 1992).*

(Continued)

*Primary Examiner* — Eric W Golightly
*Assistant Examiner* — Arlyn I Rivera-Cordero
(74) *Attorney, Agent, or Firm* — Smartpat PLC

(57) ABSTRACT

A method for rinsing an overflow chamber at the bath-side end of a snout of a device for hot-dip coating a metal strip is presented. The snout guides the metal strip in a protective gas atmosphere before the metal strip is coated with a metal melt. A rinsing cycle is carried out in the overflow chamber of the snout by feeding metal melt from the molten bath into the overflow chamber and at the same time, sucking and pumping said melt out of the overflow chamber back into the molten bath. This rinsing cycle can be performed even when
(Continued)

the snout has been retracted from the melt by supplying the melt from the molten bath to the overflow chamber with a delivery pump.

4 Claims, 1 Drawing Sheet

(52) U.S. Cl.
CPC ..... *C23C 2/00344* (2022.08); *C23C 2/325* (2022.08); *C23C 2/40* (2013.01); *C23C 2/50* (2022.08); *B08B 2209/08* (2013.01)

(56) References Cited

U.S. PATENT DOCUMENTS

| | | | |
|---|---|---|---|
| 2004/0052958 | A1 | 3/2004 | Dauchelle et al. |
| 2004/0052959 | A1 | 3/2004 | Dauchelle et al. |
| 2016/0102393 | A1 | 4/2016 | Schaffrath et al. |
| 2019/0153580 | A1 | 5/2019 | Kümmel et al. |

FOREIGN PATENT DOCUMENTS

| | | | | | |
|---|---|---|---|---|---|
| CN | 107447174 | A | | 12/2017 | |
| CN | 108842121 | A | | 11/2018 | |
| DE | 102013104267 | | | 2/2014 | |
| EP | 1339891 | B1 | | 12/2009 | |
| EP | 2989226 | B1 | | 6/2017 | |
| JP | H0459955 | | * | 2/1992 | ..... C23C 2/00 |
| JP | H0459955 | A | | 2/1992 | |
| JP | H04120258 | U | | 4/1992 | |
| JP | H08269659 | A | | 10/1996 | |
| JP | 2002275608 | | * | 9/2002 | ..... C23C 2/00 |
| JP | 2003293107 | A | | 10/2003 | |
| JP | 2012149295 | A | | 8/2012 | |
| KR | 20130062525 | | * | 6/2013 | ..... C23C 2/003 |
| KR | 20130062525 | A | | 6/2013 | |

OTHER PUBLICATIONS

KR20130062525 English Translation, accessed on Mar. 2023. (Year: 2013).*
JP2002275608 English translation, accessed on Sep. 2023. (Year: 2002).*

* cited by examiner

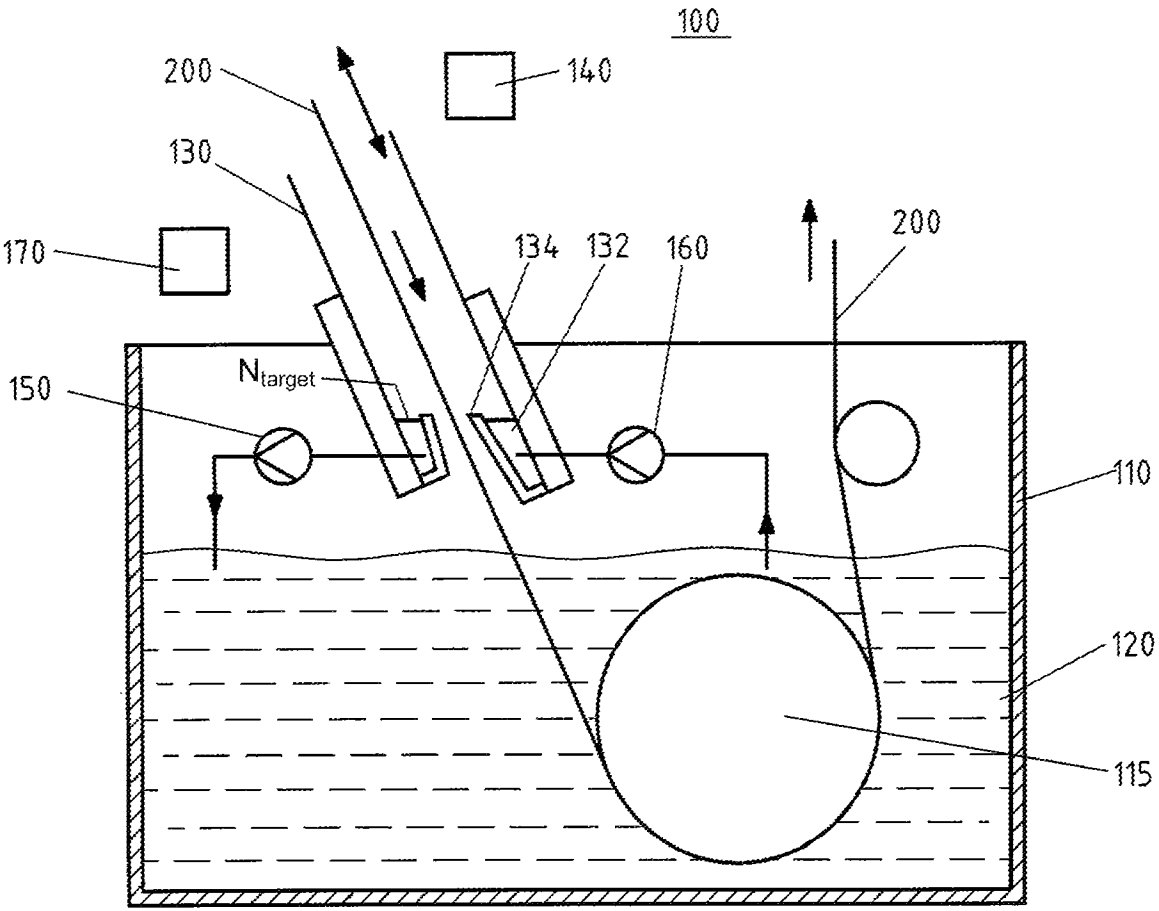
100
140
200
130
170
200
160
132
134
$N_{target}$
150
110
120
115

METHOD AND DEVICE FOR RINSING AN OVERFLOW CHAMBER AT THE BATH-SIDE END OF A SNOUT OF A HOT-DIP COATING DEVICE

TECHNICAL FIELD

The disclosure relates to a method for rinsing an overflow chamber at the bath-side end of a snout of a device for hot-dip coating a metal strip with a metal melt. Furthermore, the disclosure relates to said device for hot-dip coating with the necessary components for carrying out the method.

BACKGROUND

European patent specification EP 2 989 226 B1 discloses a device for the continuous hot-dip coating of metal strip. Such device comprises a container with a metal melt for passing the metal strip along with a snout for passing the metal strip in a protective gas atmosphere after its exit from the metal melt. The snout has at least one overflow chamber at its bath-side end for collecting impurities from the surface of the metal melt in the vicinity of the freshly coated metal strip. The device further comprises a lifting device for retracting the snout from the metal melt and/or for lowering the snout into the metal melt. Finally, the device has a suction pump for preferably continuous suction of the impurities from the overflow chamber. The overflow chamber also has at least one passage opening, also called a rinsing opening, through which fluid metal melt can flow from the molten bath into the drain chamber, which is then continuously sucked out of the overflow chamber with the aid of a suction pump. Maintaining the rinsing flow within the overflow chamber reliably ensures that slag or impurities, as the case may be, are continuously discharged from the snout, since the constant feed of fluid metal melt maintains a "soft" consistency of the slag and prevents deposits, so-called "caking," in the snout to the greatest possible extent. Without a sufficient feed of fluid metal melt, slag particles floating in the snout on the surface of the molten bath would bond with each other in the manner of sintering. The snout disclosed in EP 2 989 226 B1 can be pivoted and telescoped without interfering with slag removal. Finally, the device disclosed in said patent specification has a control or regulating device for controlling the suction pump as a function of the difference in height between the bath level and an overflow edge of the overflow chamber.

The rinsing process as known from the said prior art has the disadvantage that it can only be operated when the snout with its overflow chamber is immersed in the metal melt.

SUMMARY

The disclosure provides an improved method for rinsing an overflow chamber and an improved device for hot-dip coating a metal strip for carrying out the method in such a way that the rinsing process can be continued even after the snout has been withdrawn from the melt.

This is achieved by the method as claimed. Accordingly, the method provides that the snout with the overflow chamber is retracted from the molten bath at least to such an extent that no more melt can flow over an overflow edge in the interior of the snout into the overflow chamber and that the rinsing cycle can be carried out even when the snout has been retracted from the melt by feeding the melt from the molten bath to the overflow chamber with the aid of a delivery pump.

Particularly at the end of a coating process, for example in the transition between two metal strips to be coated or for maintenance purposes, it is occasionally necessary for the snout to be retracted from the molten bath. In such situations, the method offers the advantage that the rinsing process of the overflow chambers does not have to be interrupted, but can be continuously maintained until the overflow snout is immersed in the melt again. The uninterrupted continuation of the rinsing process of the overflow chambers even outside the melt offers the advantage that the chambers can continue to be cleaned even in this situation, for example to prevent caking, and that the dry running of the suction pump is prevented.

In accordance with a first exemplary embodiment, the method further provides that the level of the melt in the overflow chamber is controlled to a predetermined target level even when the snout is retracted from the melt by suitably varying the power of the suction pump and/or the delivery pump.

An improvement is further achieved by a device for the hot-dip coating of a metal strip with a delivery pump for carrying out the method. The advantages of this device correspond to the advantages mentioned above with reference to the claimed method.

Further advantageous embodiments of the device are the subject of the dependent claims.

BRIEF DESCRIPTION OF THE DRAWINGS

A single FIGURE showing the device for carrying out the method for rinsing an overflow chamber at the bath-side end of a snout of a device for hot-dip coating a metal strip with a metal melt is attached to the description.

DETAILED DESCRIPTION

The FIGURE shows the device 100 for hot-dip coating a metal strip 200 with a metal melt 120. The metal melt 120 is contained in a container 110. The metal strip 200 is deflected in the metal melt by a deflection roller 115 in the interior of the container. It is passed through a snout 130 prior to its entry into the metal melt 120, wherein the snout ensures that the metal strip is guided under a protective gas atmosphere prior to its entry into the metal melt 120. The snout 130 has at least one, preferably two or four, overflow chambers 132 fluidly connected to each other at its bath-side end. Such overflow chambers are used to collect slag residues or impurities from the surface from the metal melt in the vicinity of the metal strip. A suction pump 150 is provided for the preferably continuous suction of the impurities from the overflow chamber; in this manner, such slag residues or impurities are prevented from coming into contact with the freshly coated metal strip and caking there or on the inside of the snout. In addition, a lifting device 140 is provided in the snout 130 for retracting the snout 130 out of the metal melt and for lowering the snout into the metal melt; the directions of travel for the snout 130 are indicated by a double arrow in the FIGURE.

In addition to the suction pump 150, the device 100 also has a delivery pump 160 for feeding metal melt, preferably from the container 110 into the at least one overflow chamber 132, in particular even if the bath-side end of the snout is no longer immersed in the metal melt 120. Through the preferably simultaneous operation of the delivery pump 160 and the suction pump 150, it is possible to maintain a continuous rinsing in the form of a continuous melt flow in the overflow chamber 132, even when the snout is retracted from the melt, and in this manner to ensure the continuous cleaning of the overflow chamber and to prevent the suction pump from running dry.

The snout is not only formed to be raised and lowered, but also to pivot. This applies in particular to the bath-side end piece of the snout with the overflow chamber 132; however, other elements of the snout may also be formed to pivot.

The metal melt is, for example, liquid zinc. Finally, the device 100 can also include a level control 170 for controlling the level of the melt 120 in the overflow chamber 132, even when the snout 130 is retracted from the melt 120. The control is designed to adjust the level of the melt in the overflow chamber 132 to a predetermined target level $N_{Target}$ by suitably varying the power of the suction pump 150 and/or the delivery pump 160. The target level of the melt in the overflow chamber is below an overflow edge 134 of the overflow chamber 132.

LIST OF REFERENCE SIGNS

100 Device
110 Container
115 Deflection roller
120 Metal melt
130 Snout
132 Overflow chamber
134 Overflow edge
140 Lifting device
150 Suction pump
160 Delivery pump
170 Level control
200 Metal strip
$N_{Target}$ Target level

The invention claimed is:

1. A method for rinsing an overflow chamber (132) at a bath-side end of a snout (130) of a device (100) for hot-dip coating a metal strip (200), wherein the snout is used to guide the metal strip in a protective gas atmosphere before the metal strip (200) is coated with a metal melt (120), comprising the steps of:

carrying out a rinsing cycle in the overflow chamber (132) by feeding the metal melt (120) from a molten bath into the overflow chamber (132); and, at the same time, pumping the metal melt (120) out of the overflow chamber into the molten bath with a suction pump (150);

wherein the snout (130) with the overflow chamber (132) is retracted from the molten bath at least to such an extent that no metal melt can flow over an overflow edge (134) in an interior of the snout (130) into the overflow chamber, and wherein the rinsing cycle is carried out even when the snout has been retracted from the molten bath by feeding the metal melt from the molten bath to the overflow chamber (132) with a delivery pump (160), and wherein the snout (130) is entirely retracted from the molten bath.

2. A method for rinsing an overflow chamber (132) at a bath-side end of a snout (130) of a device (100) for hot-dip coating a metal strip (200), wherein the snout is used to guide the metal strip in a protective gas atmosphere before the metal strip (200) is coated with a metal melt (120), comprising the steps of:

carrying out a rinsing cycle in the overflow chamber (132) by feeding the metal melt (120) from a molten bath into the overflow chamber (132); and, at the same time, pumping the metal melt (120) out of the overflow chamber into the molten bath with a suction pump (150);

wherein the snout (130) with the overflow chamber (132) is retracted from the molten bath at least to such an extent that no metal melt can flow over an overflow edge (134) in an interior of the snout (130) into the overflow chamber, and wherein the rinsing cycle is carried out even when the snout has been retracted from the molten bath by feeding the metal melt from the molten bath to the overflow chamber (132) with a delivery pump (160), and wherein a level of the metal melt (120) in the overflow chamber (132) is controlled to a predetermined target level ($N_{Target}$) even when the snout (130) is retracted by varying a power of the suction pump (150) and/or the delivery pump (160), and wherein the target level ($N_{Target}$) is below the overflow edge (134).

3. A method for rinsing an overflow chamber (132) at a bath-side end of a snout (130) of a device (100) for hot-dip coating a metal strip (200), wherein the snout is used to guide the metal strip in a protective gas atmosphere before the metal strip (200) is coated with a metal melt (120), comprising the steps of:

carrying out a rinsing cycle in the overflow chamber (132) by feeding the metal melt (120) from a molten bath into the overflow chamber (132); and, at the same time, pumping the metal melt (120) out of the overflow chamber into the molten bath with a suction pump (150);

wherein the snout (130) with the overflow chamber (132) is retracted from the molten bath at least to such an extent that no metal melt can flow over an overflow edge (134) in an interior of the snout (130) into the overflow chamber, and wherein the rinsing cycle is carried out even when the snout has been retracted from the molten bath by feeding the metal melt from the molten bath to the overflow chamber (132) with a delivery pump (160), and wherein no metal melt flows over the overflow edge (134) when the snout (130) is retracted from the molten bath.

4. The method according to claim 3, wherein a level of the metal melt (120) in the overflow chamber (132) is controlled to a predetermined target level ($N_{Target}$) even when the snout (130) is retracted by varying a power of the suction pump (150) and/or the delivery pump (160).

* * * * *